US006670589B2

(12) United States Patent
Wyatt

(10) Patent No.: US 6,670,589 B2
(45) Date of Patent: Dec. 30, 2003

(54) HEAT RETENTIVE FOOD TRAY WITH COVER

(75) Inventor: Burk Wyatt, Brentwood, TN (US)

(73) Assignee: Aladdin Temp-Rite, LLC, Nashville, TN (US)

( * ) Notice: Subject to any disclaimer, the term of this patent is extended or adjusted under 35 U.S.C. 154(b) by 0 days.

(21) Appl. No.: 10/255,154

(22) Filed: Sep. 25, 2002

(65) Prior Publication Data

US 2003/0121907 A1 Jul. 3, 2003

Related U.S. Application Data

(60) Provisional application No. 60/334,327, filed on Nov. 29, 2001.

(51) Int. Cl.[7] ..... H05B 6/12
(52) U.S. Cl. ..... 219/621; 622/649; 126/246
(58) Field of Search ..... 219/620, 621, 219/622, 647, 649; 126/246, 375, 400; 99/DIG. 14, 451; 426/237, 241, 243

(56) References Cited

U.S. PATENT DOCUMENTS

| | | | | |
|---|---|---|---|---|
| 3,557,774 A | | 1/1971 | Kreis | 126/246 |
| 3,734,077 A | | 5/1973 | Murdough et al. | 126/246 |
| 3,916,872 A | | 11/1975 | Kreis et al. | 126/375 |
| 4,453,068 A | | 6/1984 | Tucker et al. | 219/10.77 |
| 4,776,386 A | | 10/1988 | Meier | 165/48.1 |
| 4,881,590 A | | 11/1989 | Meier | 165/48.1 |
| 4,982,722 A | | 1/1991 | Wyatt | 126/400 |
| 5,603,858 A | | 2/1997 | Wyatt et al. | 219/620 |
| 5,786,643 A | | 7/1998 | Wyatt et al. | 219/621 |
| 5,901,699 A | * | 5/1999 | McDermott | 126/246 |
| 6,005,233 A | * | 12/1999 | Wyatt | 219/621 |
| 6,232,585 B1 | * | 5/2001 | Clothier et al. | 219/620 |

* cited by examiner

*Primary Examiner*—Philip H. Leung
(74) *Attorney, Agent, or Firm*—Womble Carlyle Sandridge & Rice, PLLC

(57) ABSTRACT

A heat retentive tray system is provided that has a tray containing a heat storage member adapted to be heated by electrical induction with a cover disposed in insulating contact with a flat upper surface of the tray, thereby substantially increasing the heat retentive properties of the system.

26 Claims, 2 Drawing Sheets

HEAT RETENTIVE FOOD TRAY WITH COVER

RELATED APPLICATION

This application is related to and claims priority in, co-pending U.S. Provisional Application Ser. No. 60/334,327, filed Nov. 29, 2001, the disclosure of which is incorporated herein by reference.

BACKGROUND OF THE INVENTION

1. Field of the Invention

The present invention relates to a heat retentive food tray, and particularly a heat retentive food tray adapted to be heated by electrical induction. More particularly, the present invention relates to a heat retentive food tray with a cover, adapted to be heated by electrical induction.

2. Description of Related Art

In environments where food is prepared and cooked in a central location and distributed and served to consumers who are remotely located, such as, in hotels, aircraft and institutional settings, e.g., hospitals and nursing homes, there is often a delay between the time that the food is prepared, cooked and subsequently placed on a plate or other serving dish, and the time that the food is eventually presented to the consumer for consumption at a remote location. Accordingly, by the time the food is presented to the consumer, the food can become cold unless special measures are taken to keep the food hot. Various approaches to such meal service problems encountered in service environments, sometimes referred to as "satelliting," have been employed in the food service and container industries.

One particular embodiment of heat retentive servers can be designed to support dishware, which in turn holds a portion of a meal that is to be kept hot. In such circumstances, the base is commonly called a "pellet" base, and the entire system, i.e., the base, dome and plate, is referred to as a "pellet system." When a heat sink is incorporated into a server base and the base supports a food-carrying dish, or plate, the base can be referred to as a plate warmer.

In general, heat retentive servers employ convection or conduction heating in order to either heat a food service dish or heat a heat storage battery during food service operations.

U.S. Pat. No. 3,916,872 to KREIS et al., issued Nov. 4, 1975, discloses a heat storage dish comprising a central heat storage disk and an insulating member that surrounds the heat storage dish. The heat storage dish consists of a substantially circular metallic body member that may be equipped with a central opening. The heat storage dish may, for example, be heated by subjecting it to a high frequency field, thus inductively heating the heat storage dish. U.S. Pat. No. 3,557,774, issued Jan. 26, 1971 to KREIS, discloses a heat storage dish having a heat storage plate enclosed between an interior wall and an exterior wall, secured at their edges to prevent the entry of any external substance.

U.S. Pat. No. 4,776,386 to MEIER, issued Oct. 11, 1988, discloses an apparatus for cooling, storing and reheating food, using induction heating. This system includes a tray distribution system wherein a tray, which may be adapted to support, e.g., a soup tureen, a dish for meat, a hot beverage cup, a salad plate, and/or a similar plate such as a fruit dish, as well as a trough for cutlery, may be provided. A meal, supported on such a tray, can be stored in a refrigerated environment. In this system, the refrigerated cabinet in which the trays are stored includes induction coils. In practice, prior to serving, the cooling system of the refrigerator is turned off and the induction coils are activated to supply heat to the appropriate areas in the tray. U.S. Pat. No. 4,881,590 to MEIER, issued Nov. 21, 1989, discloses a similar system.

U.S. Pat. No. 3,734,077 to MURDOUGH et al., issued May 22, 1973, discloses a server that includes a recess in order to receive a plate. The server comprises an upper shell, a lower shell, a heating pellet and a resilient pad. The pad occupies the space between the under surface of the pellet and the lower shell and performs an insulating function, in addition to directing heat from the pellet in an upward direction rather than downwardly or laterally.

Each of the forgoing systems suffers from disadvantages. For example, systems which employ convection or conduction heating to preheat a food service container prior to employing the food service container to support, e.g., a dish having a food portion which is to be kept hot, require long "lead times" prior to being capable of being effectively used. Thus, such systems require relatively long periods of time in order to preheat the convection systems or other ovens used with said systems and in order to store enough heat in a heat sink or other heat storage means before the container can be usefully employed to keep foods warm in food service environments. Such lead times are undesirable and are typically on the order of about 60 to about 90 minutes and sometimes even longer, prior to the start of delivery or serving of the food to individual consumers.

Such food service containers including heat retentive servers and the like, suffer from other disadvantages. For example, heat retentive servers possess the disadvantage that the entire server can become hot and difficult to handle safely. Additional disadvantages include the fact that heat retentive servers which act as a heat sink, e.g., which employ a heat storage mass, tend to liberate heat in all directions. However, it is preferable to direct the heat which is liberated from the heat storage mass such that the heat is liberated substantially only within the heat retentive server itself, i.e., that portion of the heat retentive server which is enclosed by the bottom portion, side walls and dome or lid of the server. To achieve such an object, it is preferable to direct the heat given up by the heat storage mass such that the heat is directed upwardly.

U.S. Pat. No. 5,786,643 to Wyatt et al. is directed to a transportable heat retentive server, which includes a disk-shaped central portion having a disk-shaped heat storage disk. The '643 Wyatt et al. server design does not have heat retention times comparable to the present invention.

The present invention is distinguished from the above-described bases because the heat storage disk is embedded within a tray on which a plate sits. The present design requires minimal storage space, has less pieces to wash and dry, the system is lighter and further, there is no need for a base dolly. Surprisingly, the heat retention performance for the present tray system is improved by about 61% when compared with conventional heat retentive bases wherein the heat storage disk is stored in the base rather than the tray according to the present invention.

SUMMARY OF THE INVENTION

The present invention provides a heat retentive tray system including a tray that is adapted to be inductively heated and to also store heat via a heat sink disposed directly within the tray so as to keep hot foods hot. Further, the heat retentive tray system includes a dome portion, which is thermally disposed about a top surface of the tray such that it completely covers a housing for a heat sink, thereby providing additional heat retention.

The present invention also provides an inductively heated heat storage member which can be rapidly heated and ready for use in serving individual hot portions to individual consumers, in such fashion that a large number of such heat retentive trays can be "charged", and plated with food in mass production fashion, while maintaining the food at least 140° F. for more than 60 minutes.

The present invention also provides a heat retentive serving tray or the like, which can be heated by induction heating to keep selected foods hot. The serving tray includes a metal portion (i.e., a heat storage disk) that is heated to a predetermined temperature in response to electrical or electromagnetic induction, e.g., by induction heating. The metal layer is preferably centrally located and embedded within a tray and preferably circular, but can be positioned in various locations and comprise other than a circular shape. Further, the location of the disk within the tray can be such that the disk is thermally isolated from the remainder of the structure of the tray, such that heat is not conducted to the remainder of the tray, such as, by using a thermal break or insulation. For example, a thermal break is preferably incorporated as part of an expansion joint located between the heat storage mass and peripheral portions of the heat retentive tray, and insulation is preferably provided in bottom portions thereof.

Additionally, the heat retentive tray system can further comprise an upper cover or dome, wherein the upper cover and the top surface of the tray can cooperate to define an insulated volume. Preferably, the upper cover is disposed about the top surface of the tray or top shell.

The present invention provides a heat retentive tray having an upper surface, a recessed portion disposed in the tray and a heat storage member. The heat storage member is capable of being heated by induction and is disposed within the recessed portion. A portion of the upper surface that is disposed above the heat storage member can be flat. The recessed portion can be adapted to direct heat upward from the heat storage member through the upper surface. The tray can further have a top member and a bottom member that are disposed substantially adjacent to each other to form the recessed portion. The top member and the bottom member can be secured to each other by an ultrasonic annular weld. The tray can further have a fastening ring that is disposed adjacent to the top member and the bottom member for securing the top member to the bottom member. The tray can further have an expansion joint. The tray can further have a thermal break between the bottom member and the fastening ring. The tray can further have an annular cavity between the bottom member and the fastening ring, and the thermal break can be an o-ring disposed in the annular cavity. The heat storage member can be circular. The heat storage member can be centrally located in the tray. The heat storage member can have a plurality of holes disposed therein.

Additionally, the present invention provides a heat retentive tray system having a tray having an upper surface, an inner volume and a heat storage member which is capable of being heated by induction. The heat storage member is disposed in the inner volume. A portion of the upper surface that is disposed above the beat storage member can be flat. The heat retentive tray system also has a cover that is removably disposed on the portion of the upper surface above the heat storage member to form an insulated volume. The cover can have an inner wall, an outer wall and a space therebetween. The space can be at least partially filled with insulation. The inner volume can be adapted to direct heat upward from the heat storage member to the insulated volume. The cover and the upper surface can contact each other at a contact area wherein the heat from the heat storage member rises past the contact area. The tray can further have a top member and a bottom member that are disposed substantially adjacent to each other to form the inner volume. The top member and the bottom member can be secured to each other by an ultrasonic annular weld. A fastening ring can be disposed adjacent to the top member and the bottom member for securing the top member to the bottom member. The tray can further comprise an expansion joint. The tray can further have a thermal break between the bottom member and the fastening ring. The tray can also have an annular cavity between the bottom member and the fastening ring wherein the thermal break is an o-ring disposed in the annular cavity. The heat storage member can be circular. The heat storage member can be centrally located in the tray. The heat storage member can have a plurality of holes disposed therein.

The present invention further provides a method of serving food product to a plurality of consumers using the following steps:

A. subjecting a heat retentive tray comprising a substantially planar upper surface, an inner volume and a heat storage member that is susceptible to electrical induction heating and is disposed in the inner volume of the tray, to an electromagnetic field sufficient to inductively heat the heat storage member;
B. placing a quantity of food product which is disposed on a plate, onto the heat retentive tray above the heat storage member;
C. covering the tray, the inner volume where the heat storage member is disposed, the plate and the food product with an insulated cover which defines an insulated volume between the insulated cover and the tray so that ambient atmosphere does not come into contact with the plate and the food product; and
D. serving the food product to at least one of a plurality of consumers.

DETAILED DESCRIPTION OF THE PREFERRED EMBODIMENT

Figure 1:
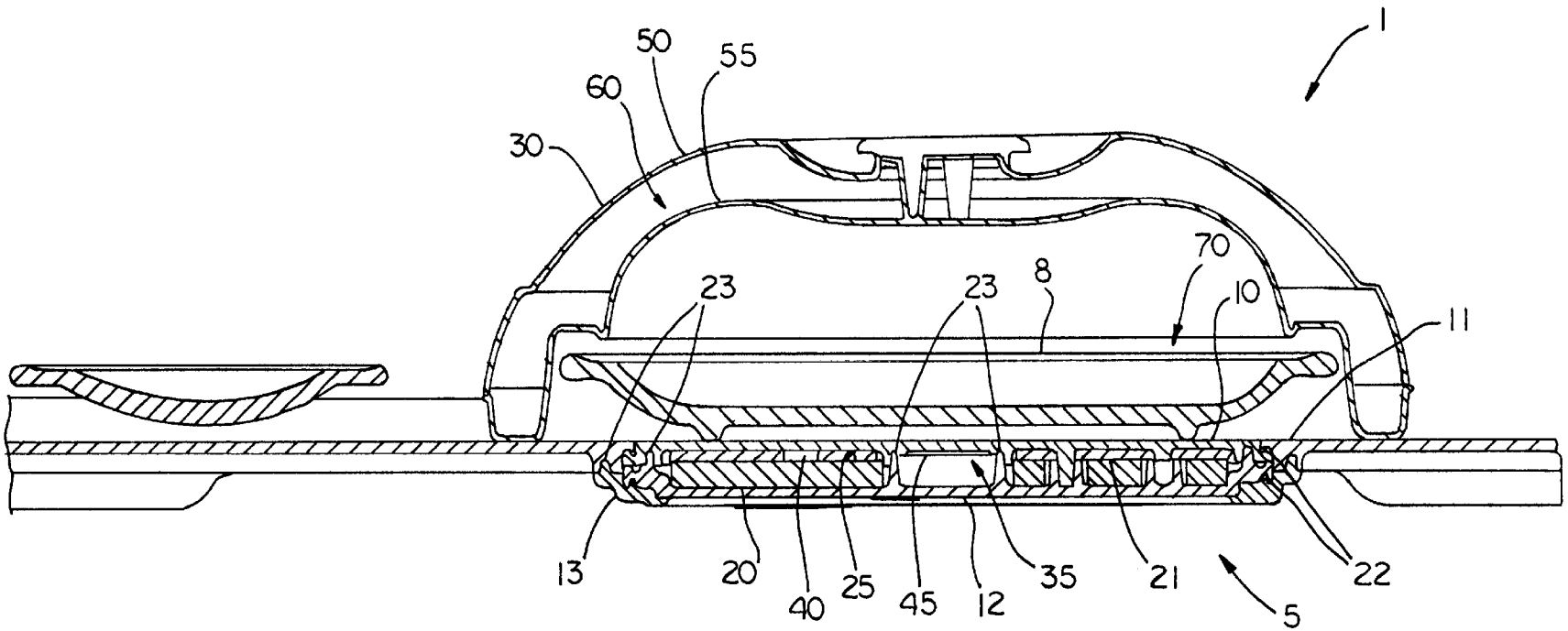
FIG. 1 is a schematic cross-sectional representation of one embodiment of the present invention.

FIG. 1 is a schematic representation of a heat retentive tray system of the present invention in transverse cross-section generally represented by reference numeral 1. In the embodiment shown in FIG. 1, a conventional plate 8 is disposed upon a heat retentive tray or tray assembly 5 of the present invention.

Heat retentive tray system 1 includes plate 8 over a top shell or generally planar tray surface 10 of tray 5. Preferably, plate 8 is provided with feet for standing on tray 5. Top shell 10 is connected to a bottom shell or bottom shell center assembly 12. Bottom shell 12 has a bottom ring 13. Disposed between top shell 10 and bottom shell 12 are insulation 20, a metal disk 21, "O" rings 22, and joints 23. A top surface 11 of tray 5 accommodates most standard 9" dishware, Heat retentive tray 5 receives plate 8, containing a hot meal portion, preferably within a substantially central portion of top surface 11 of tray 5. However, plate 8 can be other than substantially centrally located.

As used herein, the term "generally planar" refers to trays and tray-like structures that comprise a generally planar array, which can comprise a flat plane. Such a generally planar expanse is shown in plan view in FIG. 1. The top surface 11 of tray 5 and/or top shell 10 can be composed of any suitable weldable or bonded material such as a plastic material, preferably an injection-moldable plastic material such as a polyolefin-based plastic materials, such as polypropylene. Other suitable materials can be readily selected by those of ordinary skill in the art. Plate 8 holding the food can be placed onto top shell 10.

It has been found that, when metal disk 21 is employed, preferred heating results are obtained by optimizing a combination of mass of metal disk 21, diameter of metal disk 21, and thickness of metal disk 21, as well as the number of holes 40 and diameter of holes 40 which are present in metal disk 21. Metal disk 21 can be composed of any inductable material, e.g., steel, brass, nickel, self-regulating material and alloys.

In preferred embodiments, a mass of from about 450 grams to about 475 grams is preferred, an outer diameter of about 6.4 inches to about 6.6 inches is preferred, most preferably about 6.5 inches, and a thickness of about 0.117 inch to about 0.125 inch is preferred. Preferably, metal disk 21 should contain from about ten to about twelve holes 40, which are preferably generally round in top plan view, and the holes should have a diameter of from about 0.218 inch to about 0.225 inch.

In addition to the foregoing, metal disk 21 is preferably provided with a central hole 45 having a diameter of about 1.625 inches to about 1.640 inches. In preferred embodiments, central hole 45 facilitates the formation of a central annular weld joint 23 between top shell 10 and bottom shell 12, such as annular weld joint 23, shown in FIG. 1.

It has also been found that there are important considerations relating to the distance of metal disk 21 from the induction coil (not shown), in the practice of the present invention. It is preferable that metal disk 21 not be located too far away from the induction coil. For example, if metal disk 21 is too far away from the induction coil, heating will not be induced. Generally, a distance of from about 0.650 inch to about 0.750 inch from the top of the induction coil to the bottom of metal disk 21 should be employed. This is accomplished by optimizing the thickness of the induction heating top and/or the thickness of any bottom portion of heat retentive tray system 5. In general, the top of the induction coil should have a thickness which cooperates with the dimensions of heat retentive tray system 5 such that bottom surface 25 of metal disk 21 is located from about 0.650 inch to about 0.750 inch from the top surface of the induction coil (not shown), preferably from about 0.675 inch to about 0.725 inch, and most preferably about 0.690 inch to about 0.700 inch. Central portion 35 which holds metal disk 21 is preferably provided with a sheet of fiberglass insulation (not shown). The fiberglass sheet may also be retained in place by bottom shell 12.

In the embodiment of FIG. 1, bottom shell 12 cooperates with top shell 10 to substantially surround metal disk 21. The securing of top shell 10 to bottom layer or shell 12 is accomplished through suitable securing means including, but not limited to, e.g., sonic welding or ultrasonic welding. Other ways to secure top shell 10 to bottom shell 12 include solvent welding, spin welding, adhesive bonding, etc. In this embodiment, an inner annular ultrasonic weld joint 23 and an outer annular ultrasonic weld joint 23 are employed. Preferably, annular ultrasonic weld joints 23 are provided with a lead which, during welding operations, spreads or flashes up each side of weld joint 23.

Additionally, top shell 10 and bottom shell 12 are provided with cooperating extensions which are generally transverse to the plane of the top and bottom shells and which project through cooperating holes in heat storage member or metal disk 21.

Alternatively, top shell 10 and bottom shell 12 cooperate to partially enclose metal disk 21. In another alternative, metal disk 21 can be integrally injection molded as a member of central portion 35.

In the embodiment of FIG. 1, wherein top shell 10 functions as a connecting member, top shell 10 and bottom shell 12 cooperate to form an annular volume or opening, within which "O" rings 22 are received and retained. "O" rings 22 serve two purposes: (1) to prevent water infiltration and (2) to provide a thermal expansion joint. This joint comprises a thermal break. As used herein, the term "thermal break" refers to the inability of two or more parts to transmit heat one to the other by conduction due to a lack of direct contact between the parts which are subject to the thermal break, whereby the parts are "substantially thermally insulated from each other."

Bottom shell 12 can also be formed of suitable plastic materials. Preferably, bottom shell 12 is formed of heat resistant material, such as glass filled plastic resin materials. For embodiments wherein bottom shell 12 and top shell 10 are ultrasonically welded, preferred materials are those which can be ultrasonically welded, but which are also heat resistant. Suitable resins can be selected by those of ordinary skill in the art and include RADEL® glass filled resin available from Amoco of Atlanta, Ga., and VALOX® glass filled resin, available from General Electric, of Pittsfield, Mass. Preferably the resins are glass filled. A preferred material is referred to as NORYL®, available from General Electric of Pittsfield, Mass.

Bottom shell 12 is compatible with existing activators or induction heating units. Also, heat retentive tray 5 should fit into current storage racks and storage carts (not shown), as well as standard dish machine belts and wash racks.

Bottom ring 13 is secured to top shell 10 so as to provide a housing for metal disk 21 (in cooperation with bottom shell 12). Preferably, bottom ring 13 is secured to top shell 10 by ultrasonic welding.

Heat retentive tray system 1 is preferably constructed and arranged so as to direct the heat, which is stored in and liberated from heat storage member or metal disk 21 such that the heat is retained within the insulated interior area defined by central portion 35, top shell 10, and insulated dome or cover 30. This is preferably accomplished by directing the liberated heat upwardly from metal disk 21 through top shell 10. Insulation 20 thus serves to reduce or prevent heat loss from the side of tray 5 and directs the heat upwardly and inwardly to direct the heat to plate 8 containing food and supported by top shell 10. The layer of fiberglass insulation is also additionally employed for this purpose.

One influence that contributes to the unexpected retention of heat in foods placed in the present device, is the rising of heat away from the contact point between dome 30 and tray 5. Metal disk 21, as shown in FIG. 1, is located underneath the generally planar top shell 10, and is therefore also located very close to the contact point between dome 30 and top shell 10. The heat moves upwardly into the food and continues to rise up to the top of dome 30, thereby moving away from the point at which dome 30 and top shell 10 meet. Therefore, less leakage of heat occurs by virtue of the present device design.

Dome 30 of the present invention offers additional heat retentive attributes. One embodiment of dome 30 includes two walls comprising an outer or upper wall 50 and an inner or lower wall 55, which cooperate to define an insulated volume 60 that can comprise a space or be filled with insulation, such as foam (not shown). Dome 30 covers a portion of tray 5 and sits upon top shell 10, thereby substantially preventing heat from escaping insulated volume 70 which is underneath dome 30 (above tray 5).

The induction heating of the present invention is preferably conducted by placing heat retentive tray 5 on a support capable of producing heat-generating electric currents, e.g., a magnetic field generated by an electric current. The basic principles of induction heating are well-known to those of ordinary skill in the art, and are disclosed for example, in U.S. Pat. No. 4,453,068 to TUCKER et al. The entirety of this patent, and all patents and publications cited therein, are hereby incorporated by reference as though set forth in full herein, for their disclosures of the basic principles and circuitry employed in induction heating. Preferred induction heating systems are described in more detail below.

Activation for the present system is not to exceed 10 seconds. The minimum hold time for the system is about one hour when the dish temperature is 165° F. (food temp is 165° F.) assuming that dome 30 is placed on tray 5 at a speed of 3.5 trays per minute. The present system extends the "hold time" of the food above 140° F. for a time period of up to about 70 minutes.

One of the advantages of the present invention is that trays 5 can be heated extremely rapidly by induction heating, which alleviates the need for workers to arrive well prior to meal service time.

Heat retentive tray systems 1 of the present invention are heated within a period of, for example, from about 5 to about 15 seconds, preferably from about 8 to about 12 seconds, and most preferably about 10 seconds. Heating is preferably accomplished by placing tray 5 on the operating surface of an induction heating system (not shown). Preferably, the system is activated, or energized in response to a mechanical switch that is activated by the presence of tray 5. Preferably, the heating system is provided with a safety interlock system, whereby the mechanical switch cannot be activated unless a guard is first displaced in response to the presence of heat retentive tray 5.

Preferably, heat retentive trays 5 are subjected to induction heating conditions of an intensity and for a time sufficient to heat heat storage member or disk 21 to a temperature of from at least about 340° F. to about 380° F., preferably from about 360° F. to about 375° F. In general, it is preferable to heat metal disk 21 to as high a temperature as possible, without subjecting the remaining components of heat retentive tray system 1 to undue thermal stress.

When metal disk 21 is employed, it is preferably heated to such a temperature range as measured by physically contacting a probe (e.g., a thermocouple) to metal disk 21 and conducting measurements of the temperature of metal disk 21 at various locations throughout the surface of metal disk 21. A brief period of time is permitted in order to allow the temperature of metal disk 21 to equilibrate (i.e., to allow the heat to spread evenly throughout the volume of the disk). Equilibration is necessary before measurement because induction heating coils can generate hot spots.

Thus, preferably the thickness of the top of the induction heating unit should be from about 0.050 inch to about 0.100 inch, preferably from about 0.060 inch to about 0.080 inch and most preferably from about 0.070 inch to about 0.075 inch. Further, bottom surface 25 of metal disk 21 should be located from about 0.485 inch to about 0.525 inch above the surface upon which heat retentive tray 5 is supported, more preferably from about 0.490 inch to about 0.520 inch, and most preferably from about 0.495 inch to about 0.515 inch.

The induction heating unit also preferably includes a coil cooling fan and air filter, each of which are fully conventional and readily available. Also included is an inverter. Exemplary of suitable inverters is that available from Fuji Electric, of Japan, and identified as Fuji part number HFRO5OC9K-UX. Those of ordinary skill in the art can readily design and/or fabricate a suitable inverter. An EMI filter is also preferably included. Those of ordinary skill in the art can readily design and/or fabricate a suitable filter. Advantageously, the induction heating unit is also provided with a control panel.

The control panel includes a "power on" indicator, a "heating" indicator, a "ready" indicator and a "call service" indicator. Suitable additional indicators and/or controls will be readily apparent to those of ordinary skill in the art.

In use, power to the unit is turned on and the heat retentive tray system is placed on the top surface of the unit. The mechanical switch allows the coil to be energized, and the base heating indicator is activated. Heat storage member 21 is heated during this interval, which has the values in the ranges defined above. When a suitable time interval has passed to bring heat storage member 21 to the desired temperature range as discussed above, the induction coil is de-energized and the base ready indicator is activated. Heat retentive tray system 1 may then be removed from the unit, and plate 8 containing food therein may be placed in central portion 35. This process can be repeated sequentially many times, the number of repetitions being chiefly dependent upon the number of meals to be served. The plated food, so placed on tray system 1, is then served to remotely-located consumers. A holding period of finite duration will occur from the time that plate 8 having hot food thereon, is placed on tray system 1 and the time that the plate having such food in the plate is presented to the consumer. This duration will vary, depending on whether, for example, a particular tray 5 is the first or last in a series to be provided with plate 8 having food thereon. The duration will also be dependent upon practices that normally occur at institutions such as those described, which practices are normally variable.

Figure 2:
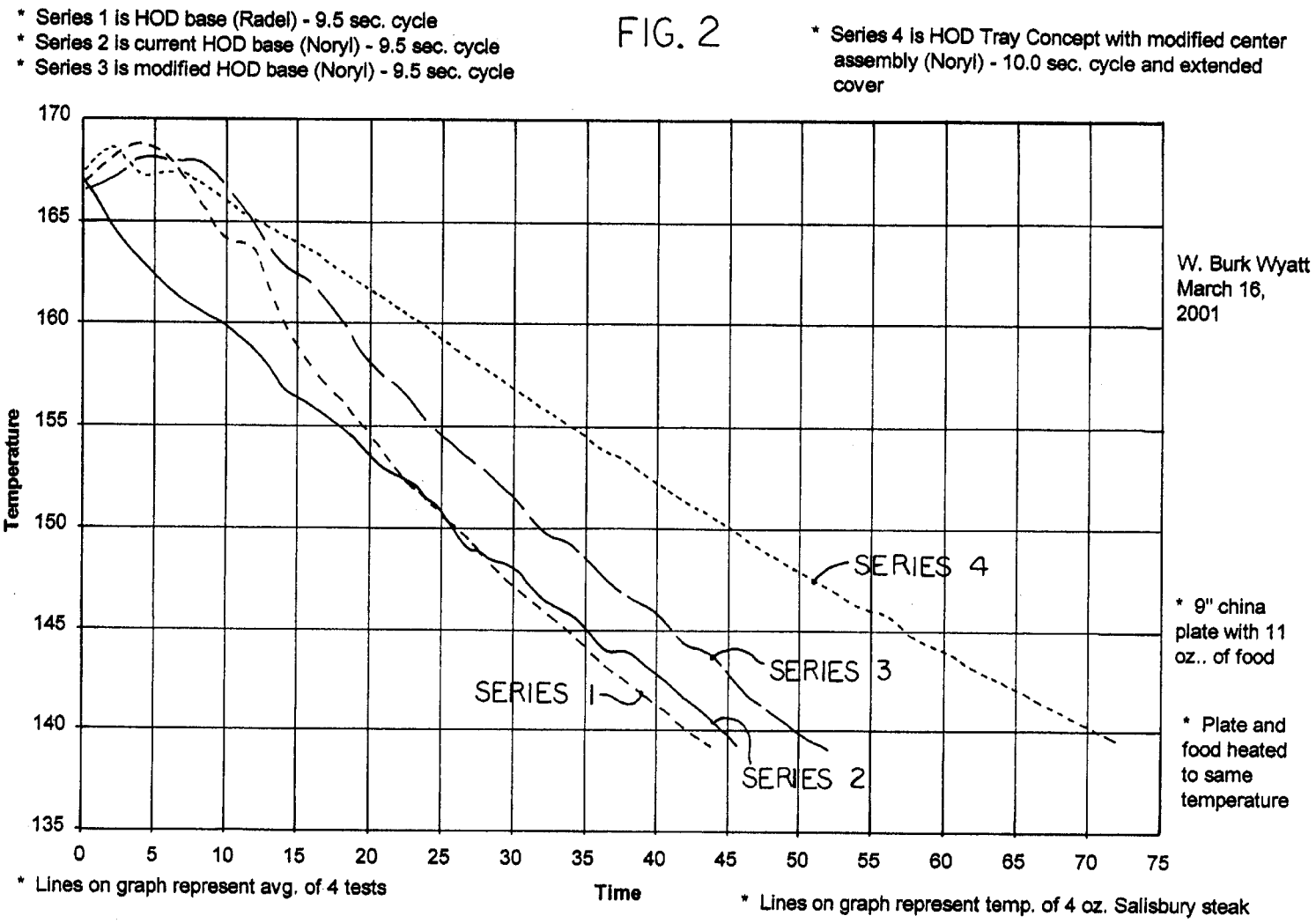
FIG. 2 is a graph plotting the temperature of food with respect to time for the heat retentive tray of the present invention versus conventional heat retentive systems.

FIG. 2 illustrates the significant difference between the performance of the present heat retentive tray system 1 over other servers. The graph monitors four series. Series 1 is a Heat on Demand® (sold by Aladdin-TempRite, LLC) delivery base, the center section composed of RADEL® plastic. Series 2 is also a Heat on Demand® delivery base, the center section composed of NORYL® plastic. Series 3 is a modified Heat on Demand® base composed of NORYL® plastic and with thicker fiberglass insulation. Series 4 is the present tray embodiment composed of NORYL® plastic including use of the insulated dome 30. Series 1–3 were heated in a 9.5 second cycle and Series 4 was heated in a 10.0 second cycle. Results shown on the graph were an average of four tests for each Series. The food temperature shown is that of a 4 oz. Salisbury steak on a 9 inch china plate with a total mass of 11 ounces of food with the food and plate heated to 165° F.

The results from the graph show a surprisingly significant difference between the present heat retentive tray system including insulated dome 30 and the other induction heated delivery bases. A temperature of 140° F. was maintained for over 70 minutes with the present tray system (Series 4), which is significantly higher than Series 3 (at about 49 minutes), Series 2, (at about 44 minutes) and Series 1 (at about 42 minutes).

The tray design is a significant improvement upon the previously referenced bases because of its compact design in which metal disk 21 is embedded within the generally planar tray 5 which includes top shell portion 10 which is the portion of tray 5 that sits over the heat storage disk 21, rather than directly in a food carrying base. Also, dome 30 contains insulation and mates directly with top or tray surface 11, providing plate 8, which sits upon tray 5, with complete coverage by dome 30. This unique combination of improvements provides the unexpected and significant heat retention shown in FIG. 2.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

What is claimed is:

1. A heat retentive tray comprising:

a generally planar upper surface having a substantially flat portion, a recessed portion disposed in the tray beneath the flat portion of the upper surface, a heat storage member which is capable of being heated by induction, and is disposed within said recessed portion, and a removable cover having a lower edge configured to seat on the flat portion of the upper surface of the tray while the cover at least covers that portion of the upper surface that is above the heat storage member.

2. The heat retentive tray of claim 1, wherein said recessed portion is adapted to direct heat upward from said heat storage member through said upper surface.

3. The heat retentive tray of claim 2, further comprising a top member and a bottom member that are disposed substantially adjacent to each other to form said recessed portion.

4. The heat retentive tray of claim 3, wherein said top member and said bottom member are secured to each other by an ultrasonic annular weld.

5. The heat retentive tray of claim 3, further comprising a fastening ring that is disposed adjacent to said top member and said bottom member for securing said top member to said bottom member.

6. The heat retentive tray of claim 5, further comprising a thermal break between said bottom member and said fastening ring.

7. The heat retentive tray of claim 6, further comprising an annular cavity between said bottom member and said fastening ring, and wherein said thermal break is an o-ring disposed in said annular cavity.

8. The heat retentive tray of claim 1, further comprising an expansion joint.

9. The heat retentive tray of claim 1, wherein said heat storage member is circular.

10. The heat retentive tray of claim 1, wherein said heat storage member is centrally located in said tray.

11. The heat retentive tray of claim 1, wherein said heat storage member has a plurality of holes disposed therein.

12. A heat retentive tray system comprising:

a tray having a generally planar upper surface having a substantially flat portion, an inner volume beneath the flat portion of the upper surface, and a heat storage member which is capable of being heated by induction, wherein said heat storage member is disposed in said inner volume, and a cover removably disposed on at least a portion of the flat portion of the upper surface above said heat storage member to form an insulated volume.

13. The heat retentive tray system of claim 12, wherein said cover has an inner wall, an outer wall and a space therebetween.

14. The heat retentive tray system of claim 13, wherein said space is at least partially filled with insulation.

15. The heat retentive tray system of claim 12, wherein said inner volume is adapted to direct heat upward from said heat storage member to said insulated volume.

16. The heat retentive tray system of claim 12, wherein said cover and said upper surface contact each other at a contact area and wherein heat from said heat storage member rises past said contact area.

17. The heat retentive tray system of claim 12, wherein said tray further comprises a top member and a bottom member that are disposed substantially adjacent to each other to form said inner volume.

18. The heat retentive tray system of claim 17, wherein said top member and said bottom member are secured to each other by an ultrasonic annular weld.

19. The heat retentive tray system of claim 17, further comprising a fastening ring that is disposed adjacent to said top member and said bottom member for 10 securing said top member to said bottom member.

20. The heat retentive tray system of claim 19, wherein said tray further comprises a thermal break between said bottom member and said fastening ring.

21. The heat retentive tray system of claim 20, wherein said tray further comprises an annular cavity between said bottom member and said fastening ring, and wherein said thermal break is an o-ring disposed in said annular cavity.

22. The heat retentive tray system of claim 17, wherein said tray further comprises an expansion joint.

23. The heat retentive tray system of claim 12, wherein said heat storage member is circular.

24. The heat retentive tray system of claim 12, wherein said heat storage member is centrally located in said tray.

25. The heat retentive tray system of claim 12, wherein said heat storage member has a plurality of holes disposed therein.

26. A method of serving food product to a plurality of consumers, the method comprising the steps of:

A. subjecting a heat retentive tray comprising a substantially planar upper surface having a substantially flat portion, an inner volume beneath said flat portion and a heat storage member that is susceptible to electrical induction heating and is disposed in said inner volume of said tray, to an electromagnetic field sufficient to inductively heat said heat storage member;

B. placing a quantity of food product which is disposed on a plate, onto said heat retentive tray above said heat storage member;

C. covering said tray, said inner volume where said heat storage member is disposed, said plate and said food product with an insulated cover which defines an insulated volume between said insulated cover and the flat portion of the upper surface of said tray so that ambient atmosphere does not come into contact with said plate and said food product; and D. serving said food product to at least one of the plurality of consumers.

* * * * *